US009789616B2

(12) United States Patent
Mimura

(10) Patent No.: US 9,789,616 B2
(45) Date of Patent: Oct. 17, 2017

(54) ROTARY ELECTRIC SHAVER

(71) Applicant: IZUMI PRODUCTS COMPANY, Matsumoto-shi, Nagano (JP)

(72) Inventor: Yoshiyuki Mimura, Matsumoto (JP)

(73) Assignee: IZUMI PRODUCTS COMPANY, Matsumoto-Shi (JP)

( * ) Notice: Subject to any disclaimer, the term of this patent is extended or adjusted under 35 U.S.C. 154(b) by 125 days.

(21) Appl. No.: 14/718,268

(22) Filed: May 21, 2015

(65) Prior Publication Data

US 2015/0343652 A1 Dec. 3, 2015

(30) Foreign Application Priority Data

May 30, 2014 (JP) ..... 2014-113266

(51) Int. Cl.
*B26B 19/14* (2006.01)

(52) U.S. Cl.
CPC ..... *B26B 19/141* (2013.01)

(58) Field of Classification Search
CPC ..... B26B 19/141; B26B 19/143
USPC ..... 30/346.51, 43.4–43.6; D28/50
See application file for complete search history.

(56) References Cited

U.S. PATENT DOCUMENTS 2,314,264 A * 3/1943 Abrams ..... B26B 19/141 30/43.6
2,365,368 A 3/1944 Verschuyl
2,824,367 A * 2/1958 McWilliams ..... B26B 19/14 30/43.6
3,116,551 A * 1/1964 Anton ..... B26B 19/141 30/43.6
3,125,808 A * 3/1964 Starre ..... B26B 19/141 30/43.6
3,261,091 A * 7/1966 Van Den Driest .... B26B 19/141 30/43.6
3,381,373 A * 5/1968 Brown ..... B26B 19/148 30/43.6
3,648,367 A * 3/1972 Tolmie ..... B26B 19/042 30/43.6
3,656,235 A * 4/1972 Zuurveen ..... B26B 19/145 30/43.5
3,800,417 A * 4/1974 Tietjens ..... B26B 19/141 30/43.6
3,890,709 A * 6/1975 Tietjens ..... B26B 19/141 30/43.6

(Continued)

FOREIGN PATENT DOCUMENTS

DE 1005405 B * 3/1957
EP 1 566 247 A1 8/2005

(Continued)

OTHER PUBLICATIONS

Extended European Search Report issued in related EP Application No. 15167550.1 on Oct. 13, 2015 (in English).

*Primary Examiner* — Jason Daniel Prone
(74) *Attorney, Agent, or Firm* — Birch, Stewart, Kolasch & Birch, LLP

(57) ABSTRACT

A rotary electric shaver includes a blade unit which has an outer blade with multiple hair inlets formed therein and an inner blade which rotates while coming into sliding contact with a lower surface of the outer blade. The inner blade has multiple small blades, and the small blades are formed in a shape in which rake angles of a blade edge are a small angle and a large angle depending on the radial position.

10 Claims, 5 Drawing Sheets

(56) References Cited

U.S. PATENT DOCUMENTS 3,925,888 A * 12/1975 Bozsanyi ..... B26B 19/148 30/43.6
4,192,065 A * 3/1980 Tietjens ..... B26B 19/14 30/43.6
4,227,301 A * 10/1980 Van Hemmen ..... B26B 19/141 30/43.6
4,262,416 A * 4/1981 Van Hemmen ..... B26B 19/141 30/43.6
4,281,453 A * 8/1981 Bakker ..... B26B 19/141 30/43.6
4,589,205 A 5/1986 Tanahashi
4,635,360 A * 1/1987 Tanahashi ..... B26B 19/14 30/43.6
D288,251 S * 2/1987 Izumi ..... D28/50
4,707,923 A * 11/1987 Tietjens ..... B26B 19/141 30/43.6
D294,981 S * 3/1988 Izumi ..... D28/50
D294,982 S * 3/1988 Izumi ..... D28/50
4,729,169 A * 3/1988 Asawa ..... B26B 19/141 30/43.6
4,998,352 A * 3/1991 Tietjens ..... B26B 19/14 30/43.6
5,119,558 A * 6/1992 van Erp ..... B26B 19/384 30/43.6
D355,276 S * 2/1995 Uchiyama ..... D28/50
D355,504 S * 2/1995 Uchiyama ..... D28/50
5,390,416 A * 2/1995 Uchiyama ..... B26B 19/143 30/43.6
5,408,749 A * 4/1995 Momose ..... B26B 19/141 30/43.6
D365,420 S * 12/1995 Momose ..... D28/50
5,544,414 A * 8/1996 Dekker ..... B26B 19/14 30/43.6
D405,231 S * 2/1999 Nakano ..... D28/50
D405,921 S * 2/1999 Nakano ..... D28/50
6,073,350 A * 6/2000 Elston ..... B26B 19/06 30/216
6,085,421 A * 7/2000 Jorna ..... B26B 19/141 30/43.6
6,199,282 B1 * 3/2001 Uchiyama ..... B26B 19/141 30/43.6
6,502,309 B2 * 1/2003 De Vries ..... B26B 19/42 30/43.6
6,769,179 B2 * 8/2004 Satoh ..... B26B 19/04 30/43.6
6,952,879 B2 * 10/2005 Okabe ..... B26B 19/141 30/43.6
6,968,620 B2 * 11/2005 Okabe ..... B26B 19/14 30/43.6
7,178,242 B2 * 2/2007 Okabe ..... B26B 19/141 30/346.51
7,356,929 B2 * 4/2008 Nakano ..... B26B 19/141 30/346.51
7,665,214 B2 * 2/2010 Okabe ..... B26B 19/141 30/43.4
7,698,819 B2 * 4/2010 De Wit ..... B26B 19/141 30/43.5
8,151,467 B2 * 4/2012 Wllem ..... B26B 19/141 30/346.51
8,245,404 B2 * 8/2012 Minkes ..... B26B 19/141 30/346.51
8,307,740 B2 * 11/2012 Minkes ..... B26B 19/141 30/346.51
8,397,604 B2 * 3/2013 Akkerman ..... B21D 53/64 30/436
8,434,233 B2 * 5/2013 Okabe ..... B26B 19/141 30/346.51
8,806,762 B2 * 8/2014 Blaauw ..... B26B 19/044 30/346.51
9,409,301 B2 * 8/2016 Kuijper ..... B26B 19/143 30/43.6
2004/0078985 A1 * 4/2004 Chen ..... B26B 19/141 30/43.6
2007/0113408 A1 5/2007 Okabe
2008/0172881 A1 * 7/2008 Okabe ..... B26B 19/141 30/43.6
2013/0145627 A1 * 6/2013 Murzynski ..... B26B 19/14 30/43.5
2013/0145629 A1 * 6/2013 Murzynski ..... B26B 19/3893 30/346.51
2014/0352153 A1 * 12/2014 Zuider ..... B26B 19/141 30/43.6
2015/0040403 A1 * 2/2015 Campbell ..... B26B 19/141 30/43.6
2015/0082637 A1 * 3/2015 Liu ..... B26B 19/143 30/43.6
2016/0082607 A1 * 3/2016 Shimizu ..... B26B 19/143 30/43.6
2016/0089799 A1 * 3/2016 Mimura ..... B26B 19/143 30/43.6

FOREIGN PATENT DOCUMENTS

JP 2007-135991 A 6/2007
JP 2015-071002 A 4/2015
WO WO 2010089692 A1 * 8/2010
WO WO 2014085977 A1 * 6/2014

* cited by examiner

Y PORTION

A-A

B-B

C-C

ROTARY ELECTRIC SHAVER

CROSS-REFERENCE TO RIMMED APPLICATION

This application is based upon and claims the benefit of priority of the prior Japanese Patent Application No. P2014-113266, filed on May 30, 2014, and the entire contents of which are incorporated herein by reference.

FIELD

The present invention relates to a rotary electric shaver.

BACKGROUND

For example, PTL 1 discloses a rotary electric shaver which cuts hair entering multiple hair inlets while including an outer blade having the multiple hair inlets formed therein and an inner blade rotating while coming into sliding contact with a lower surface of the outer blade.

CITATION LIST

Patent Literature

PTL 1: JP-A-2007-135991

SUMMARY

Here, the present inventor has extensively studied and found out that the rotary electric shaver including the inner blade as disclosed in PTL 1 can improve hair cutting quality by forming a rake angle of a blade edge of the inner blade (small blade) into an acute angle.

On the other hand, if the rake angle of the blade edge of the inner blade (small blade) is formed into the acute angle, a shape of the blade edge becomes thin, thereby weakening rigidity thereof. Accordingly, the present inventor has found out that a conflicting problem occurs in that the cutting quality decreases since the blade edge gradually becomes blunt as the blade edge is used (cuts the hair) frequently.

The present invention is made in view of the above-described circumstances, and an object thereof is to provide a rotary electric shaver which can improve cutting quality and can prevent a blade edge from becoming blunt.

Solution to Problem

As one embodiment, means for solving the above-described problem is disclosed as follows.

According to the disclosure, there is provided a rotary electric shaver which includes a blade unit having an outer blade having multiple hair inlets formed therein and an inner blade rotating while coming into sliding contact with a lower surface of the outer blade. The inner blade has multiple small blades, and the small blades are formed in a shape in which rake angles of a blade edge are a small angle and a large angle depending on radial positions of the small blades.

Advantageous Effects

According to the present invention, cutting quality can be improved when hair is cut, and it is possible to prevent a blade edge from becoming blunt progressively.

DESCRIPTION OF THE EMBODIMENTS

Figure 1:
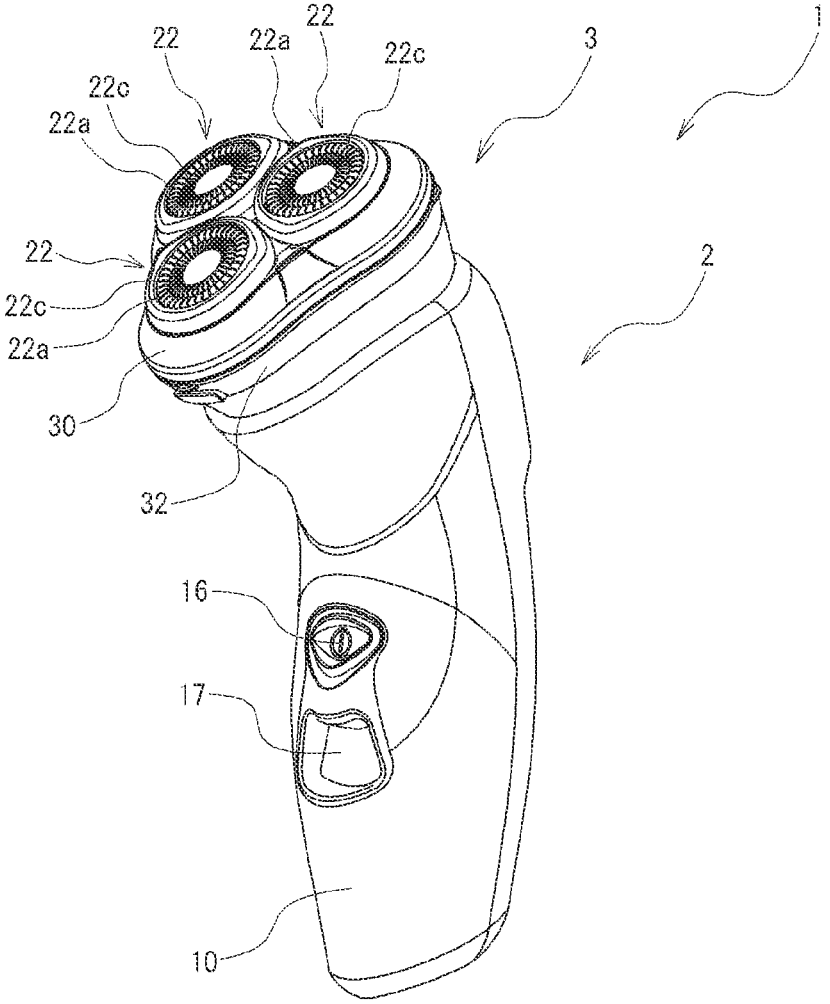
FIG. 1 is a schematic view (perspective view) illustrating an example of a rotary electric shaver according to an embodiment of the present invention.
Figure 2:
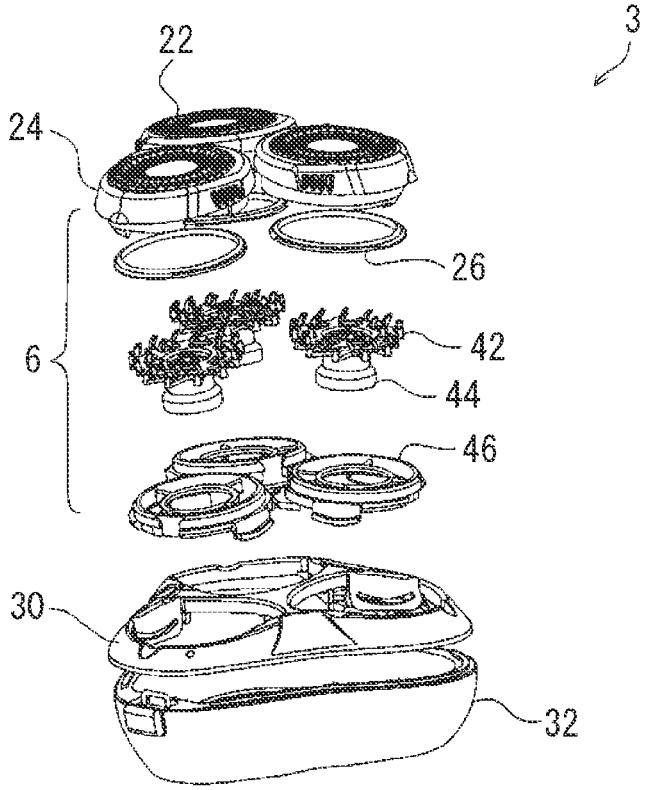
FIG. 2 a schematic view (exploded perspective view) illustrating an example of a head unit in the rotary electric shaver illustrated in FIG. 1.

Hereinafter, a first embodiment of the present invention will be described in detail with reference to the drawings. FIG. 1 is a schematic view (perspective view) illustrating an example of a rotary electric shaver 1 according to the present embodiment. In addition, FIG. 2 is a schematic view (exploded perspective view) illustrating an example of a head unit 3 of the rotary electric shaver 1. In all the drawings for describing embodiments, the same reference numerals are given to members having the same function, and in some cases, repeated description thereof will be omitted.

As illustrated in FIGS. 1 and 2, the rotary electric shaver 1 according to the present embodiment includes an outer blade 22 having multiple penetrating hair inlets (slits to be described later) 22*c* formed therein and an inner blade 42 rotating while coming into sliding contact with a lower surface of the outer blade 22, and is a rotary electric shaver which cuts hair entering the multiple hair inlets 22*c* by using the outer blade 22 and the inner blade 42. In this invention, examples of the hairs include beards, mustache, whisker, and the like. An example will be described in which the rotary electric shaver 1 has three sets of blade unit 6 including the outer blade 22 and the inner blade 42. However, the present embodiment is not limited thereto.

In FIG. 1, the reference numeral 2 is a main body, and includes a substantially cylindrical case 10. A motor for rotatably driving the inner blade 42, a battery for supplying electric power to the motor, and a control unit for controlling the rotary drive (all not illustrated) are accommodated inside the case 10. A switch button 16 for turning on and off a power source is disposed on a front surface of the case 10. A display unit 17 having an LEI) lamp for indicating battery residual capacity is disposed below the switch button 16.

As illustrated in FIG. 2, the head unit 3 includes a head case 32 which is held by being connected to an upper portion of a case 10 of a main body 2, a blade frame 30 which covers the head case 32 from above, a drive mechanism (not illustrated) which is accommodated in an inner bottom portion of the head case 32, and the three sets of blade units 6 which are held in the blade frame 30 so as to be slightly and vertically movable and swingable. Here, each blade unit 6 includes the outer blade 22 having a substantially disc shape and the inner blade 42 rotating while coming into sliding contact with the lower surface (inner surface) of the outer blade 22. In addition, the three sets of blade units 6 are arranged so as to form a triangle in a plane view. As described above, the present embodiment employs a case example where the three sets of blade units 6 are included therein. However, a basic configuration may be similarly conceivable even in a case where blade units are included in an alternative combination other than the three sets.

Here, the outer blade 22 is configured so that multiple radial slits 22*c* serving as hair inlets are formed to penetrate in an axial direction (that is, direction the same as the axial direction of a rotation axis of the inner blade) and the inner blade 42 cuts hair entering the slits 22*c*. That is, the outer blade 22 is configured so that an upper surface 22*a* serves as a shaving surface which comes into contact with skin of a user and the slits 22*e* are open on the upper surface (shaving surface) 22*a*. As an example, the upper surface (shaving surface) 22*a* is formed in an annular plane. In addition, the outer blade 22 has a shape whose peripheral edge is bent downward and an outer blade ring 24 is fitted into the peripheral edge. A stopper ring 26 is fitted into an inner periphery of the outer blade ring 24, and the outer blade 22 is fixed to the outer blade ring 24.

On the other hand, the inner blade 42 is fixed to an inner blade holder 44, and a recess to which an upper end of an inner blade drive shaft (not illustrated) connected to an output shaft of the motor is fitted is formed in a lower portion of the inner blade holder 44. The inner blade 42 is held so as to be swingable to the outer blade 22 side by an inner blade rest 46 fitted into the outer blade 24, thereby forming three sets of independent blade unit 6.

The blade units 6 are assembled by including the above-described configuration. In this manner, the inner blade 42 (small blade 42A to be described later) is in a state of coming into contact with the outer blade 22 (lower surface 22*b* to be described later). In this state, the inner blade 42 is rotatably driven, thereby cutting the hair entering the hair inlets (slits) 22*c* by using a blade edge of the inner blade 42 (small blade 42A).

Figure 3A:
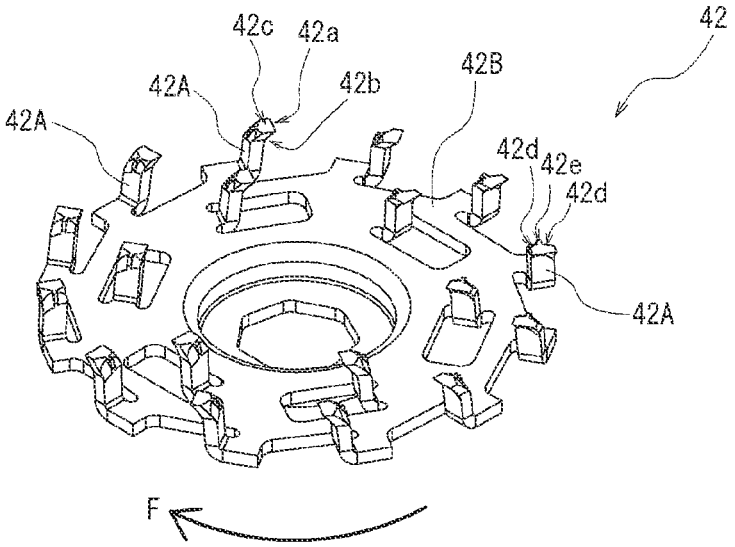
FIGS. 3A and 3B are schematic views illustrating an example of an inner blade in the rotary electric shaver illustrated in FIG. 1.
Figure 3B:
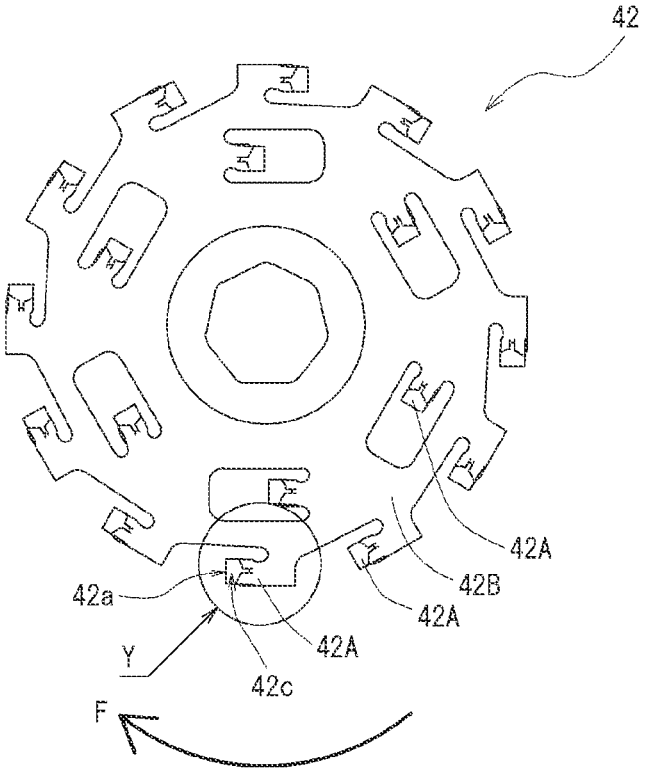
Figure 4:
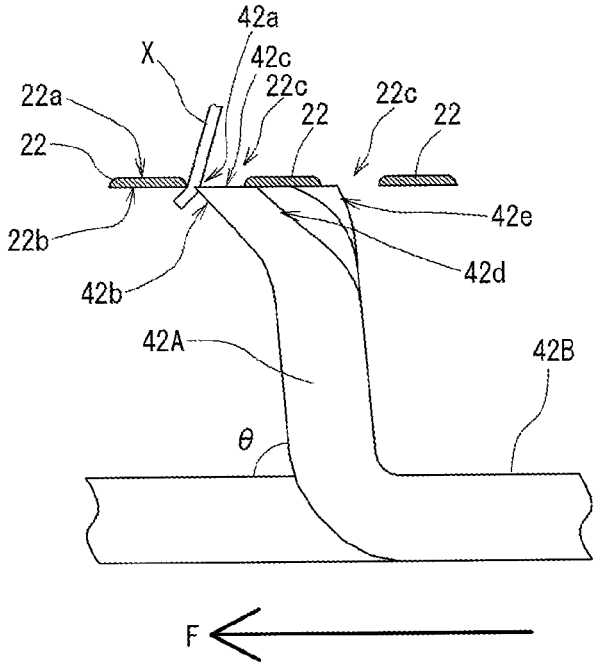
FIG. 4 is a schematic view (side view) illustrating a small blade of the inner blade and a portion of an outer blade in the rotary electric shaver illustrated in FIG. 1.

Hereinafter, a configuration of the inner blade 42 will be described in detail with reference to FIGS. 3A, 3B, and 4. FIGS. 3A and 3B are schematic views illustrating an example of the inner blade 42, FIG. 3A is a perspective view, and FIG. 3B is a plan view. In addition, FIG. 4 is an enlarged view (side view) illustrating the small blade 42A of the inner blade 42 and a portion of the outer blade 22. In the respective drawings, the rotation, direction of the inner blade 42 is illustrated as a direction of an arrow F.

As illustrated in FIGS. 3A, 3B, and 4, the inner blade 42 according to the present embodiment is configured to include multiple small blades 42A in which a metal plate is partially disposed upright with respect to a plate surface 42B (reference numeral is given to only a few small blades in order to simplify the illustration). As an example, the small blades 42A are disposed upright so that an angle θ of a front side angle (upright angle) in the rotation direction with respect to the plate surface 42B of the metal plate satisfies $45° \leq \theta \leq 135°$. An upper end portion of the small blades 42A is formed to be bent forward in the rotation direction.

In the present embodiment, the inner blade 42 is formed as an integral structure in such a way that a metal plate made of stainless steel is used, and punching and bending are performed thereon by means of pressing. In this manner, the inner blade 42 can be formed so as to have a simple structure through fewer processes. Accordingly, it is possible to decrease component cost and assembly cost. However, the present embodiment is not limited to the integral structure.

As an example, the small blade 42A according to the present embodiment has a substantially prismatic shape having a rectangular cross section in which one side is approximately 1 mm, the other side is approximately 0.5 mm, and the length (length from a root to the blade edge) is approximately 3 mm. However, the present embodiment is not limited to the dimension and the shape. If the length is further shortened, it is possible to improve rigidity of the small blade 42A, and it is possible to prevent deflection or vibration from occurring during operation. Therefore, cutting quality is further improved.

In addition, in the small blade 42A, a blade edge 42*a* for cutting hair entering the hair inlets (slits) 22*c* is formed in a front side distal end in the rotation direction. More specifically, in the small blade 42A, an upper end edge defined by a front side surface 42*b* and an upper end surface 42*c* in the rotation direction configures the blade edge 42*a*.

Figure 5A:
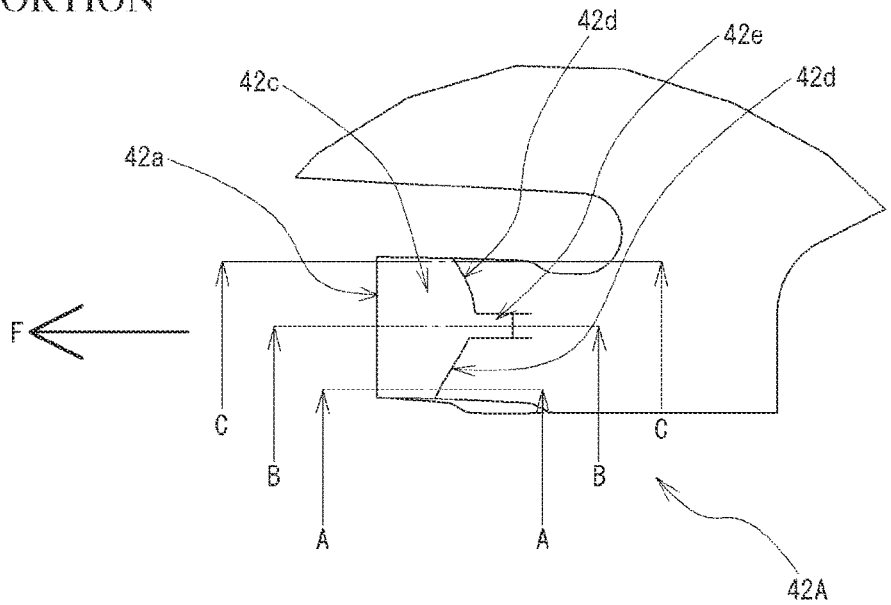
FIGS. 5A to 5D are enlarged views illustrating an example of the small blade of the inner blade illustrated in FIGS. 3A and 3B.
Figure 5B:
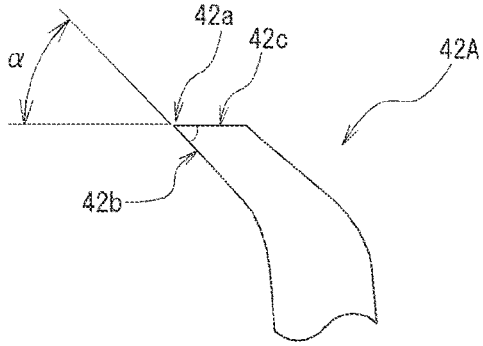
Figure 5C:
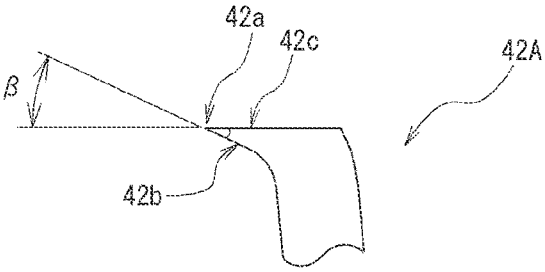
Figure 5D:
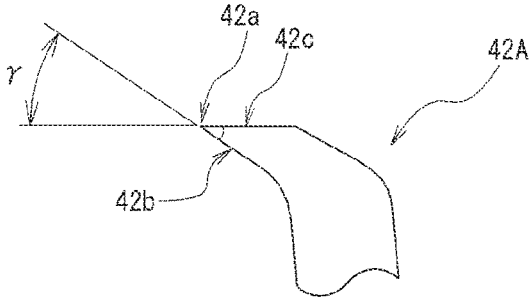

FIGS. 5A to 5D illustrate a configuration example of the small blade 42A according to the present embodiment. FIG. 5A is an enlarged view of a Y portion in FIG. 3B, that is, an enlarged plan view of the small blade 42A. In addition, FIG. 5B is a cross-sectional view taken along line A-A in FIG. 5A, that is, a cross-sectional view (cross-sectional view taken along a plane orthogonal to the radial direction) at a radially outer position of the small blade 42A. FIG. 5C is a cross-sectional view taken along line B-B in FIG. 5A, that is, a cross-sectional view (cross-sectional view taken along a plane orthogonal to the radial direction) at a radially center position of the small blade 42A. FIG. 5D is a cross-sectional view taken along line C-C in FIG. 5A, that is, a cross-sectional view (cross-sectional view taken along a plane orthogonal to the radial direction) at a radially' inner position of the small blade 42A. As illustrated in FIGS. 5A to 5D, a rake angle at the radially outer position of the blade edge 42*a* is set to α, a rake angle at the radially center position of the blade edge 42*a* is set to β, and a rake angle at the radially inner position of the blade edge 42*a* is set to γ.

The small blade 42A according to the present embodiment is formed in a shape in which the rake angles of the blade edge 42*a* are a small angle and a large angle depending on the radial positions of the small blade 42A.

For example, the small blade 42A is formed in a shape in which the rake angle β at the radially center position of the blade edge 42*a* is a relatively small angle. In contrast, the small blade 42A is formed in a shape in which the rake angle α at the radially outer position of the blade edge 42*a* is a relatively large angle and the rake angle γ at the radially inner position of the blade edge 42*a* is a relatively large angle. A relationship between α and γ is not particularly limited. Any one may be larger, or both of these have the same size.

More specifically, the small blade 42A according to the present embodiment is formed so that shapes of the blade edge 42*a* satisfy $\beta<\alpha$ and $\beta<\gamma$. As described above, the relationship between α and γ may be either $\gamma \leq \alpha$ or $\alpha \leq \gamma$.

As an example, the small blade 42A is formed so that the shapes of the blade edge 42*a* show $\beta<\alpha$ and $\beta<\gamma$ among α, β, and γ which respectively satisfy $30° \leq \alpha \leq 80°$, $20° \leq \beta \leq 45°$, and $30° \leq \gamma \leq 80°$.

According to this configuration, the small blade 42A is configured to include a portion (that is, radially central position of the blade edge 42*a*) having a relatively small angle, that is, a sharp rake angle in the blade edge 42*a*. When hair X is cut at the corresponding portion, an advantageous effect of improved cutting quality can be obtained. However, since the corresponding portion is formed so that the rake angle of the blade edge 42*a* is small, the shape of the blade edge 42*a* becomes relatively thin, thereby weakening the rigidity. Accordingly, there is a problem in that the cutting quality decreases since the blade edge 42*a* gradually becomes blunt as the blade edge 42*a* is used (cuts the hair) frequently.

On the other hand, the small blade 42A is configured to include a portion having a relatively large rake angle, that is, an obtuse rake angle in the blade edge 42*a* (that is, radially outer portion and radially inner portion of the blade edge 42*a*). Since the corresponding portions are formed so that the rake angle of the blade edge 42*a* is large, the shape of the blade edge 42*a* becomes relatively thick, thereby enabling the rigidity to be strengthened. Accordingly, it is possible to prevent the cutting quality from decreasing since the blade edge 42*a* gradually becomes blunt as the blade edge 42*a* is used (cuts the hair) frequently.

In this manner, conflicting problems can be solved by adopting a configuration in which the small blade 42A of the inner blade 42 according to the present embodiment includes the blade edge 42*a* formed in a shape in which the rake angle β at the radially center position is small and the rake angles α and γ at the radially outer position and the radially inner position are large. That is, it is possible to improve and maintain the cutting quality when hair is cut, and it is possible to prevent the blade edge 42*a* from gradually becoming blunt as the blade edge 42*a* is used repeatedly.

In addition, in an upper end portion region including the upper end surface 42*c* in the small blade 42A, a thin portion 42*d* formed by reducing a rear side region in the rotation direction on a cross section parallel to the rotation surface (cross section taken by a plane parallel to the plate surface 42B of the metal plate) is formed in a partial region (in the present embodiment, radially outer position and inner position) in the direction orthogonal to the rotation direction (that is, radial direction). In contrast, a portion which does not reduce the rear side region in the rotation direction on the cross section parallel to the rotation surface is formed in the remaining region in the radial direction (in the present embodiment, radially center position) as a thick portion 42*e*.

That is, dimensions in the rotation direction show a shape in which the thin portion 42*d* is relatively short and the thick portion 42*e* is relatively long. In the present embodiment, the upper end surface 42*c* is formed in a convex shape protruding rearward in the rotation direction (refer to FIG. 5A). As an example, the thin portion 42*d* is formed by means of pressing. However, the present embodiment is not limited to the processing method.

According to this configuration, in the upper end portion region of the small blade 42A, the thin portion 42*d* is formed in a partial region in the radial direction. In this manner, as compared to a case where the upper end portion of the small blade 42A formed upright is simply cut by a plane parallel to the rotation direction, it is possible to further minimize an area of the upper end surface 42*c* which is formed by the upper end portion of the small blade 42A being polished. In this way, it is possible to further minimize the area of the upper end surface 42*c* of the small blade 42A which comes into sliding contact with the lower surface 22*b* of the outer blade 22. Accordingly, it is possible to decrease sliding resistance.

Here, if all regions in the radial direction are formed as the thin portion. 42*d*, strength in the upper end portion of the small blade 42A cannot be ensured. In contrast, in the present embodiment, a configuration is adopted in which the thin portion 42*d* is formed in a partial region in the radial direction and the thick portion 42*e* is formed in the remaining region. Accordingly, the thick portion 42*e* can function as a reinforcing rib. As a result, the strength in the upper end portion of the small blade 42A can be ensured while the area of the upper end surface 42*c* of the small blade 42A is minimized.

In particular, according to the present embodiment, it is possible to ensure the strength at the radially center position of the upper end portion of the small blade 42A. Therefore, it is possible to realize a configuration in which the rake angle of the blade edge 42*a* at the radially center position is formed to be a relatively small angle.

As described above, according to the rotary electric shaver according to the present invention, it is possible to improve and maintain the cutting quality when hair is cut. In the meanwhile, it is possible to prevent the blade edge from gradually becoming blunt as the blade edge is used frequently. In this way, conflicting problems can be solved.

Without being limited to the above-described embodiment, the present invention can be modified in various ways within the scope not departing from the gist of the present invention. In particular, as an example, the rotary electric shaver has been described which includes three sets of combination (blade unit) between the outer blade and the inner blade. However, the present invention is not limited thereto.

What is claimed is:

1. A rotary electric shaver comprising:

a blade unit including an outer blade unit having multiple hair inlets formed therein and an inner blade unit rotating while coming into sliding contact with a lower surface of the outer blade unit, wherein the inner blade unit has multiple cutting blades, each of the cutting blades has a single cutting edge extending in a radial direction, and wherein the single cutting edge of at least one of the cutting blades has rake angles that vary along the radial direction.

2. The rotary electric shaver according to claim 1, wherein said at least one of the cutting blades has a rear side region opposite to said single cutting edge of said at least one of the cutting blades and the rear side region has a varying thickness.

3. The rotary electric shaver according to claim 1, wherein $\beta<\alpha$ and $\beta<\gamma$ are satisfied for the rake angles that vary along the radial direction of the single cutting edge of the at least one of the cutting blades when a rake angle at a radially outer portion is set to α, a rake angle at a radially center portion is set to β, and a rake angle at a radially inner portion of the respective single cutting edge is set to γ.

4. The rotary electric shaver according to claim 3, wherein said at least one of the cutting blades has a rear side region opposite to said single cutting edge of said at least one of the cutting blades and the rear side region has a varying thickness.

5. The rotary electric shaver according to claim 1, wherein the rake angles that vary along the radial direction of the at least one of the cutting blades comprises a rake angle β at a radially center portion, a rake angle α at a radially outer portion and a rake angle γ at a radially inner portion.

6. The rotary electric shaver according to claim 5, wherein said at least one of the cutting blades has a rear side region opposite to said single cutting edge of said at least one of the cutting blades and the rear side region has a varying thickness.

7. The rotary electric shaver according to claim 5, wherein $\beta<\alpha$ and $\beta<\gamma$ are satisfied for the rake angles that vary along the radial direction of said single cutting edge of the at least one of the cutting blades.

8. The rotary electric shaver according to claim 7, wherein said at least one of the cutting blades has a rear side region opposite to said single cutting edge of said at least one of the cutting blades and the rear side region has a varying thickness.

9. The rotary electric shaver according to claim 5, wherein for said single cutting edge of the at least one of the cutting blades, $30° \leq \alpha \leq 80°$, $20° \leq \beta \leq 45°$, and $30° \leq \gamma \leq 80°$.

10. The rotary electric shaver according to claim 9, wherein said at least one of the cutting blades has a rear side region opposite to said single cutting of said at least one of the cutting blades and the rear side region has a varying thickness.

* * * * *